United States Patent [19]

Gauch

[11] 4,332,209

[45] Jun. 1, 1982

[54] THREAD TRIMMING MECHANISM FOR SEWING MACHINES

[75] Inventor: Hermann Gauch, Moglingen, Fed. Rep. of Germany

[73] Assignee: Union Special G.m.b.H., Stuttgart, Fed. Rep. of Germany

[21] Appl. No.: 167,087

[22] Filed: Jul. 9, 1980

[30] Foreign Application Priority Data

Jul. 13, 1979 [DE] Fed. Rep. of Germany ..... 2928270

[51] Int. Cl.[3] ..... D05B 65/06

[52] U.S. Cl. ..... 112/287; 112/288; 112/294

[58] Field of Search ..... 112/287, 288, 294, 297, 112/291, 296, 293

[56] References Cited

U.S. PATENT DOCUMENTS

| | | | |
|---|---|---|---|
| 2,140,416 | 12/1938 | Collar | 112/294 X |
| 3,109,399 | 11/1963 | Hornberger, Sr. | 112/287 |
| 3,143,987 | 8/1964 | Daniel et al. | 112/287 |
| 3,182,620 | 5/1965 | Hornberger, Sr. | 112/287 |
| 3,418,954 | 12/1968 | Svendsen et al. | 112/294 |
| 3,541,984 | 11/1970 | Daniel | 112/287 |
| 3,557,730 | 1/1971 | Armstead, Jr. | 112/287 |
| 3,624,734 | 11/1971 | Schips | 112/287 |
| 4,091,756 | 5/1978 | von Hagen | 112/287 |

*Primary Examiner*—H. Hampton Hunter

*Attorney, Agent, or Firm*—John W. Harbst; John A. Schaerli

[57] ABSTRACT

A thread trimming mechanism which includes a fixed blade arranged adjacent the stitch forming area of the sewing machine and a resiliently biased movable blade adapted to cooperate in a scissor-like action with the fixed blade. The movable blade is mounted such that varying degrees of contact pressure may occur between the blades during the thread trimming cycle of the mechanism.

10 Claims, 7 Drawing Figures

THREAD TRIMMING MECHANISM FOR SEWING MACHINES

FIELD OF THE INVENTION

This invention relates to sewing machines and, more particularly, to a thread trimming mechanism for sewing machines.

BACKGROUND OF THE INVENTION

Thread cutters for sewing machines are well known in the art. It is also well known in the art to provide thread cutters wherein a suction tube is provided to draw in any excessive threads depending from the workpiece. An example of this type of thread cutter is shown in U.S. Pat. No. 3,143,987 to H. F. Daniel et al, and granted Aug. 11, 1964. In these thread cutters, the movable knife is frequently made of spring steel. The knife is manufactured such that, when assembled, it presses against the fixed blade and the contact pressure between the blades is adjusted by utilizing the resiliency of the knife blade. However, a drawback with this design is that the contact pressure between the knives depends upon the resiliency of the movable knife. To assure severance of the threads, the knives are adjusted with a relatively high contact pressure therebetween. As may be appreciated, this high contact pressure results in rapid wearing of the knives. The rapid wearing of the knives is particularly apparent when the knives are used in high speed machines and wherein the knives are driven continuously.

SUMMARY OF THE INVENTION

In view of the above, and in accordance with the present invention, there is provided a thread trimming mechanism which overcomes the heretofore known disadvantages inherent with these types of thread trimming mechanisms. The problem of overcoming the rapid wear of the knives is essentially solved by providing a pivotally mounted, resiliently biased movable knife that normally operates under only a light pressure, but automatically adjusts to a heavier cutting pressure when a thread chain or material is introduced between the knives. In this manner, a relatively slight contact pressure is exerted against the movable knife for the majority of its operation. Satisfactory cutting is achieved despite this small contact pressure since the contact pressure between the blades is automatically increased when the thread chain or material to be severed is introduced between the knives.

The increase in contact pressure is a result of the manner in which the movable knife is mounted. In the preferred embodiment, the reciprocal knife is provided with two oppositely extending arms. One arm is pivotally carried on a knife holder at a position removed from the other arm. The distal end of the other arm is formed as a cutting blade thus creating, in effect, a lever arm. The cutting edge of the reciprocal blade is resiliently biased into contact with the fixed blade under a light pressure. During the sewing operation of the machine only slight contact pressure is maintained between the knives. When a thread chain or material passes between the knives, however, the contact of the reciprocal blade with the chain or depending material causes the blade to turn about its pivot, and, thus, the blade is urged against the fixed blade with an increasing amount of pressure as a result of the manner in which it is pivotally secured at its other end. The increase in contact pressure is effective only for the time in which the chain or material passes between the blades. Once the chain has been severed, the blade is returned to its normal operating characteristics whereby a relatively slight contact pressure is maintained between the knives. Another advantage of the present invention is that the knife mechanism is independently operated from the mechanisms of the machine, thus reducing the parts wear and work for the machine. Another advantage of the present invention is the provision of an operator actuated means which allows the selective variation of the shear angle between the blades.

It is, therefore, the primary object of this invention to provide a thread trimming mechanism which is designed to significantly reduce knife wear.

It is another object of this invention to provide a thread trimming mechanism which is independently operable of the sewing machine.

It is another object of this invention to provide a thread trimming assembly which is simple and economical to manufacture.

BRIEF DESCRIPTION OF THE DRAWINGS

Having in mind the above objects and other attendant advantages that would be evident from an understanding of this disclosure, the invention comprises the devices, combinations, and arrangements of parts as illustrated in the presently preferred embodiment of the invention which is hereinafter set forth in detail so as to enable those skilled in the art to readily understand the functions, operation, construction, and advantages of it when read in conjunction with the accompanying drawings in which.

DETAILED DESCRIPTION OF THE PRESENT INVENTION

Figure 1:
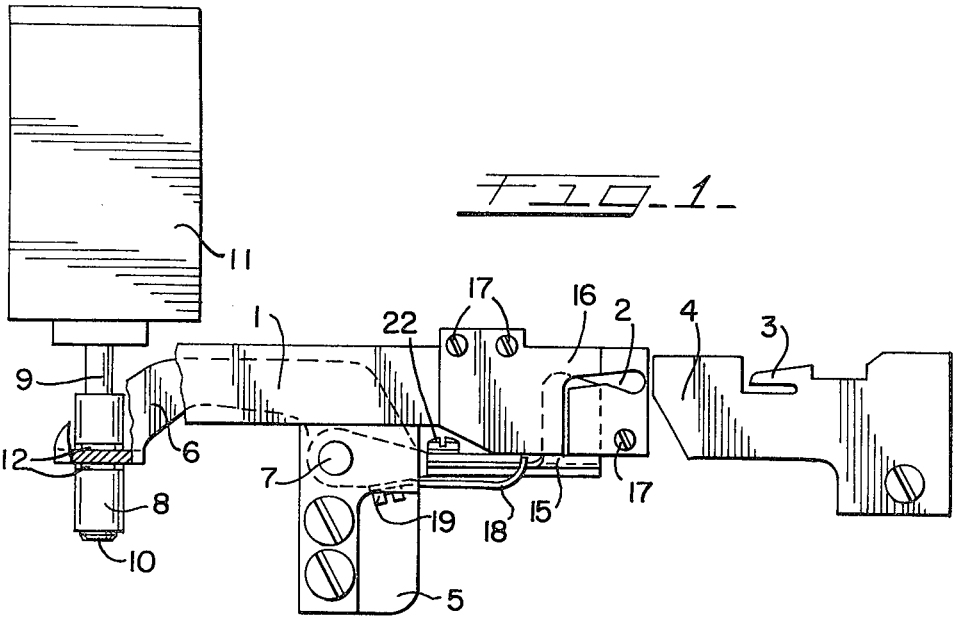
FIG. 1 is a top plan view, partly in section, of the present invention disposed in the region of stitch formation of an overedge sewing machine.
Figure 2:
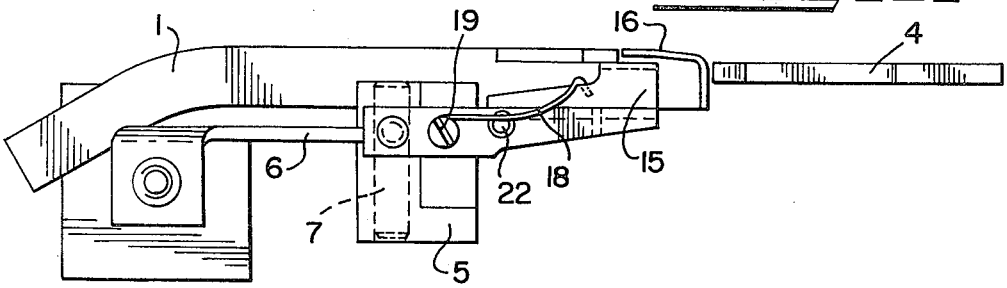
FIG. 2 is an elevational view showing various elements of the construction illustrated in FIG. 1.
Figure 4:
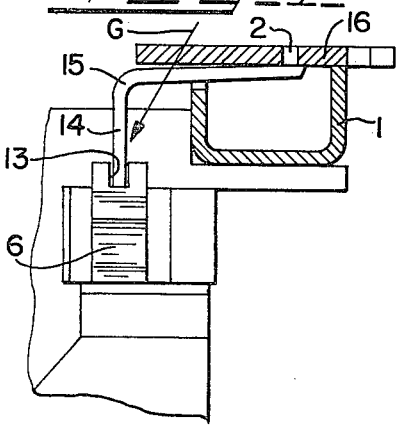
FIG. 4 is a vertical sectional view taken along Line 4—4 of FIG. 3.
Figure 5:
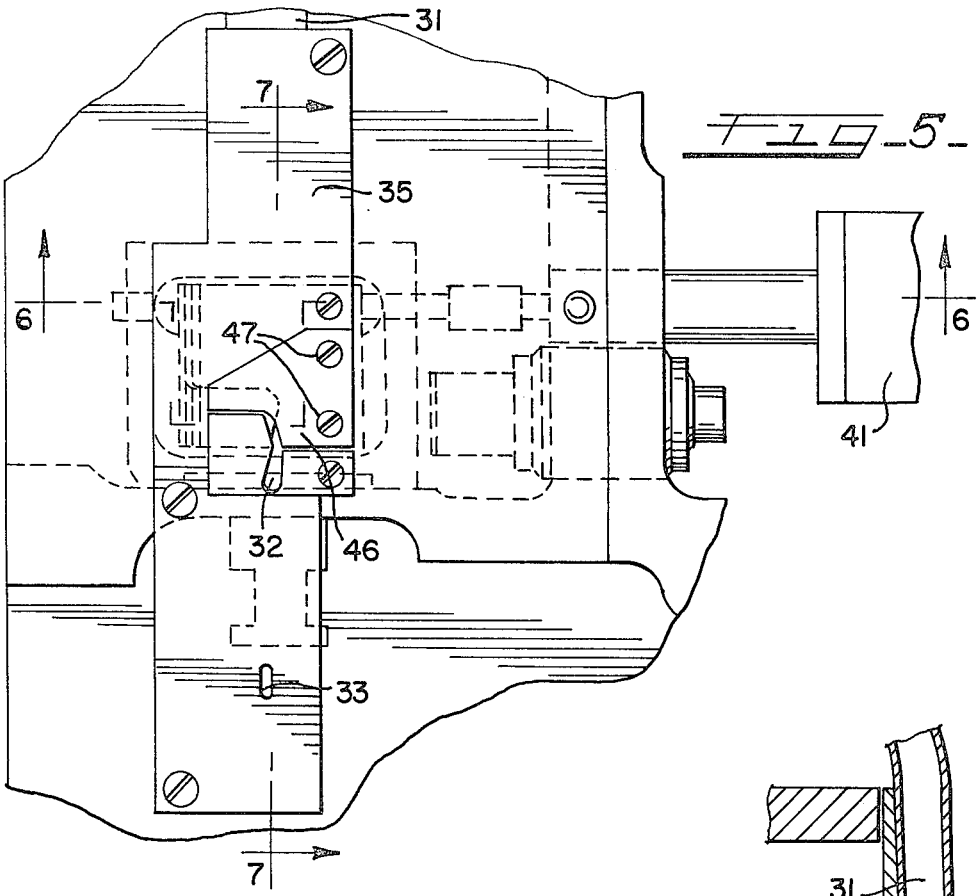
FIG. 5 is a view similar to FIG. 1, showing a modified form of the present invention as applied to a flatbed sewing machine.
Figure 6:
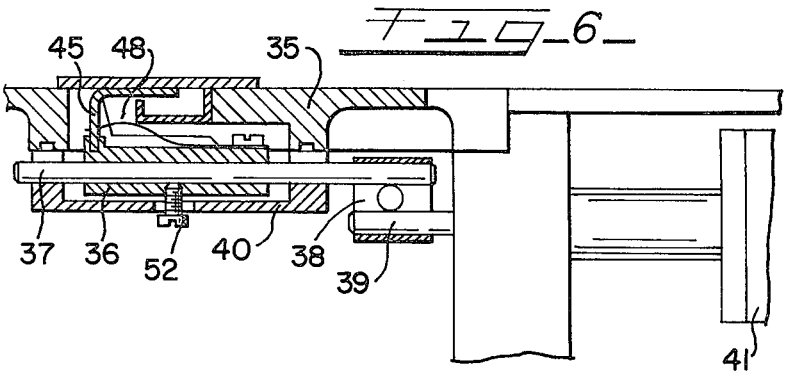
FIG. 6 is a sectional view taken along Line 6—6 of FIG. 5.
Figure 7:
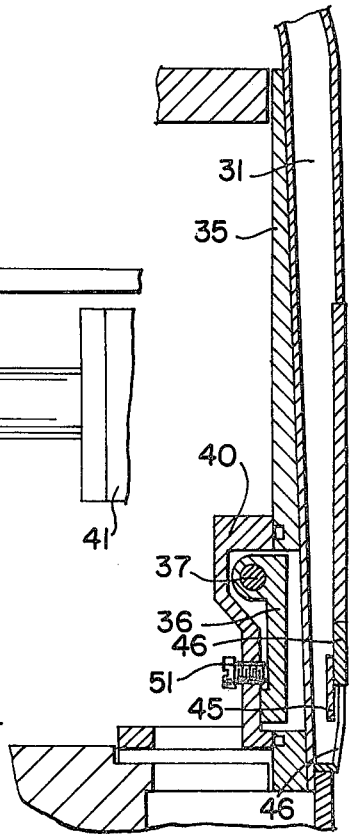
FIG. 7 is a sectional view taken along Line 7—7 of FIG. 5.

For simplicity of disclosure of the invention, the drawings illustrate very little of the structure of the sewing machine to which the invention is applied. It may be mentioned that the embodiments illustrated in FIGS. 1–4 are of types adapted to be used in connection with overedge sewing machines. A sewing machine of this character to which the invention may be readily applied is disclosed in the U.S. Pat. No. to Wallenberg et al, 2,704,042 granted Mar. 15, 1955. The devices illustrated in FIGS. 5–7 are adapted for application to a flatbed sewing machine of the type well known in the art. Typical of the numerous patents which illustrate flatbed sewing machines to which the invention may be applied, are the U.S. Pat. Nos. to Attwood, 2,729,179— granted Jan. 3, 1956; and Attwood 2,780,192—granted Feb. 5, 1957.

Turning now to FIGS. 1 through 4 of the drawings, wherein like reference numerals indicate like parts throughout the several views, there is illustrated a work support including a throat plate 4 for an overedge sewing machine of the character mentioned above. It will be understood that suitable stitch forming devices (not shown) are provided for producing an overedge line of stitching in the work. The throat plate 4 is provided with a stitch finger or tongue 3 in the region of stitch formation and on which a chain of stitches may be formed as a result of continued sewing in the areas intermediate each successive workpiece. The stitch tongue 3 extends rearward in the same direction as that which the workpieces are caused to advance during the sewing operation. Immediately adjacent the stitch forming area of the machine, is a tubular member or conduit 1 having a closure plate 16 secured to the inlet end or chamber of the tube 1 by screws 17. The closure plate 16 is provided with an opening 2 into which the trailing thread chain may be readily drawn by suction created within the tube. The tube 1 may be supported on a carrier 5 which serves to locate the inlet opening 2 immediately adjacent the stitch forming area of the machine. The carrier 5 also provides a pivotal support for a knife holder 6.

The knife holder 6 is comprised of a lever, the mid-section of which is secured for pivotal movement about a pin 7 arranged in the carrier 5. One end of the holder or member 6 is operatively secured to the operative end 9 of a driver 11. In the preferred embodiment, the driver 11 is arranged independent from the machine and, thus, produces no wear or increase in work for the machine. A retention or connection member 8 serves to operatively secure the driver 11 to the lever 6. The connection member 8 is threadably secured to the rod 9 and includes resilient plugs 12 disposed on either side of the lever 6. Suitable fastener means 10 serve to secure the connection means to the lever and the plugs 12 are adapted to allow for any tolerance compensation which may be required.

Figure 3:
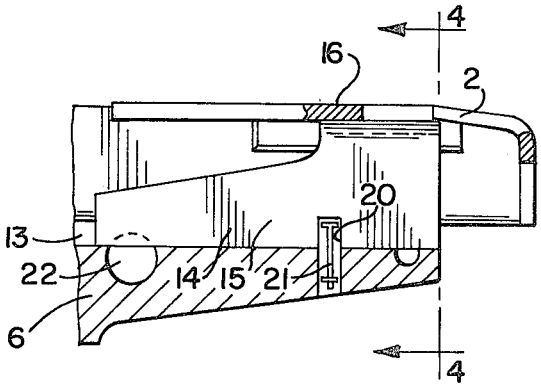
FIG. 3 is an enlarged sectional view, showing the recipricatory blade mounted in its holder.

The other end of the lever 6 serves as the knife holder for the movable blade 15. The free end of lever 6 is provided with a recess or slot 13 which is adapted to accomodate one arm 14 of knife 15. It should be noted that the arm 14 of knife 15 fits loosely in the slot 13 of the knife holder such that a pivotal relationship is established therebetween. The other arm of the knife 15, which extends in a direction opposite to arm 14, terminates in a blade portion which is located directly beneath the closure plate 16 in the area of the opening 2. As best seen in FIG. 3, the mounting arrangement of the knife 15 is such that the cutting portion of the knife is on a slight angle in relation to the closure plate 16. By this construction, closure plate 16 with opening 2 serves as a fixed blade or knife blade while blade 15 is adapted to cooperate therewith in a scissor-like action during operation of the thread trimming mechanism.

The knife 15 is continually subject to the force of a resilient member or spring 18, which may be adjustably secured to the lever 6 by any suitable fastening means such as screw 19. The free end of the spring 18 bears against the arm 14 of knife 15 whereby continually urging the arm 14 in the direction of arrow G (FIG. 4). As a result of the spring force, the terminal end of arm 14 is continually urged toward the groove in the knife holder 16 and the blade portion of the knife 15 is simultaneously pressed against the closure plate 16 whereby creating a lever arm.

As best seen in FIG. 4, the edge of knife arm 14 may be provided with a recess 20. Secured in the knife holder 6 is a pin 21 which is adapted to engage the recess 20 so as to secure the knife 15 against lateral displacement in the groove 13. The arm 14 of blade 15 also engages with an operator controlled eccentric 22. Adjustment of the eccentric allows the operator to selectively adjust the shere angle between the fixed blade or closure plate 16 and the reciprocal knife or blade 15.

In operation, the thread chain, formed by a series of interlocked stitches, may readily be drawn into the opening 2 by the suction or negative pressure created within the tube 1 as the workpiece exits from the stitch forming area of the machine. It should be appreciated that the motor or driver 11 is adapted to continuously drive or pulsate the blade during the sewing operation. Thus, when the thread chain passes between the blades of the thread trimming assembly, at the beginning and/or end of a seam, it will be automatically severed by the reciprocal scissor-like action of the blades 15 and 16. It should be appreciated that the motor or driver 11 is adapted to continuously drive or pulsate the blade during the sewing operation. The uniqueness of the present invention is exemplified by the increase in contact pressure between the blades when the threads are severed. As mentioned above, the contact pressure between the blades is relatively low until the threads or material are introduced between the blades. As a result of the unique mounting arrangement of the reciprocal blade, the blade contact pressure is increased when the movable blade contacts the depending material or thread chain. This increase in pressure lasts only for that amount of time that the movable blade 15 remains in contact with the thread chain or material depending through the slot 2 and is positioned between the blades 15 and 16. That is, due to the removed pivotal support position for knife 15, a moment is exerted on the knife when the blade portion of knife 15 contacts the threads thereby increasing the contact pressure between the blade portion and the fixed knife 16. Once the obstruction, i.e. threads or material, to movement of the blade 15 is overcome, the knives are returned to their initial contact pressure which is supplied by the force exerted by the spring 18.

In FIGS. 5, 6, and 7 there is shown a slightly modified form of thread cutter adapted for use with a flatbed sewing machine. In this embodiment, a suction tube or conduit 31 is secured to a carrier 35. The inlet end or chamber of the tube 31 is closed by a closure plate 46 which is provided with a thread inlet opening 32. In the preferred embodiment, the inlet opening 32 may be arranged in alignment with a needle hole 33 formed in the throat plate of the machine. A driver or carrier 37 is slidably mounted in an extension 40 of carrier 35. Intermediate its ends, the carrier 37 is adapted to support a knife holder 36. At one end, the driver is operatively connected to the operative end 39 of an independent drive 41 that is adapted to pulsate the movable blade during operation of the machine. The driver 37 may be connected to the operative end 39 of driver 41 by a suitable connection means 38.

The knife holder 36 is provided with a recess or groove that is dimensioned such that it loosely holds the depending arm of knife 45. The other end of knife 45 extends beneath the closure plate in the area of the inlet opening 32. The side walls of the inlet opening 32 serve as a fixed blade which when combined with the reciprocatory action of the movable blade 45, imparts a scissor-like cutting action to sever any thread which may enter between the blades. A spring 48 is adapted to continually urge the terminal end of knife arm 44 into the groove or slot 43 while simultaneously urging the blade portion of knife 45 to bear against the closure plate or fixed knife 46. The shear angle between the blades 45 and 46 may be adjusted by selectively varying the position of the carrier 36 relative to the driver 37 until the desired relationship is achieved. To accomplish this end, operator controlled means 51 are provided to affect the shear angle between the blades. Also, the lateral blade 45 relative to the fixed blade may be effected through adjustment of the carrier 36 relative to the driver 37. This end may be accomplished through the means of operator controlled means 52.

By comparing the preferred embodiments shown in the drawings versus the heretofore known thread trimming assemblies, the advantages of the present invention will be apparent. As was mentioned above, with the present invention, a relatively slight contact pressure is maintained between the blades of the mechanism for the majority of the trimming cycle. Only when the thread chain or material is introduced between the blades is the blade contact pressure increased so as to assure severance of the thread chain or material. Once the thread chain or material has been severed, the blades are returned to their normal contact pressure and the cycle continues. The light contact pressure on the knives not only reduces wear but also reduces the amount of friction and, thus, work required to drive the mechanism.

While the invention has been shown and described in relation to single thread chain producing sewing machines, it may readily be adapted for the severing of a plurality of thread chains produced by a multiple-needle sewing machine in which individual rows of stitches are formed. For this purpose, a plurality of cutting devices of the character described may be provided alongside of each other. This is in the event that the needle spacing is relatively large. However, a single section tube having a wide inlet chamber with a plurality of section openings and having a plurality of thread chain severing devices, one aligned with each of the openings, may be employed. Alternatively, particularly where the needle spacing is not great, one pair of cutting knives may be employed, these having a plurality of cutting edges, one position in spaced alignment with each of the section openings that are, in turn, aligned with the paths of movement of the thread chains.

Thus, it is apparent that there has been provided, in accordance with the invention, a thread trimming mechanism for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A sewing machine thread cutting mechanism comprising:

fixed knife means mounted adjacent the stitch forming area of the sewing machine;

resiliently biased reciprocal knife means having a blade portion adapted to cooperate with said fixed knife means, said reciprocal knife means being arranged such that said blade portion is normally and continually biased against said fixed knife means under a first low contact pressure and is adapted to cooperate with said fixed knife means under a second higher contact pressure when a thread chain is introduced between the fixed and reciprocal knife means.

2. A sewing machine thread cutting arrangement comprising:

a knife assembly including a pair of cooperating blade means, one of said blade means being fixed and the other being reciprocably movable into a scissor-like cutting action with said fixed blade;

said reciprocal blade means being arranged upon a driven blade holder;

said reciprocal blade means includes an arm which is pivotally mounted on said driven blade holder in a position removed from whereat the blade means cooperate to sever the threads; and means operative to pivotally urge the reciprocal blade means toward said fixed blade under a resilient variable pressure.

3. The thread cutting arrangement of claim 2 wherein the driven blade holder is provided with a recess into which the reciprocal blade is pivotally mounted.

4. The thread cutting arrangement of claim 3 wherein the means operative is effective to urge the reciprocal blade means toward the recess in said blade holder.

5. The thread cutting arrangement of claim 2 further comprising operator actuated means for selectively varying the shear angle established between the fixed blade and the reciprocal blade means.

6. The thread cutting arrangement of claim 2 wherein the driven blade holder is mounted to pivot about an axis extending generally perpendicular to path traversed by the reciprocal blade means and is adjustable about that axis.

7. A sewing machine thread cutting mechanism comprising:

a suction tube;

closure means arranged at the inlet end of said tube provided with an opening extending therethrough, said opening being of sufficient size to permit a chain of thread to pass therethrough into said suction tube;

pivotally mounted thread severing means one end of which is disposed inside of said tube in the area of said opening between said closure means and the longitudinal axis of said suction tube for severing surplus thread from a stitched article immediately subsequent to the stitching thereof;

means for shifting the thread severing means into a cutting relationship with the thread chain when the later is drawn into said tube; and resilient means for normally biasing the enclosed end of said thread severing means against said closure means.

8. A sewing machine thread trimming arrangement comprising:

a suction tube formed with a closure plate at one end, said closure plate being formed with a thread inlet opening;

mounting means adapted to position said thread inlet opening proximate the stitch forming area of the machine;

reciprocal blade means provided with an arm adapted to extend through said suction tube and movable across the thread inlet opening with a scissor action to sever any thread extending therethrough and a second arm extending in a direction opposite to the first arm and terminating in a pivotal mounting relationship with a knife holder;

a knife holder pivotally arranged on said mounting means, one end of said member means being adapted to pivotally support the second arm of said reciprocal blade means, the other end being operatively connected to an independent pulsating drive mechanism; and spring means adapted to continually urge the cutting end of said reciprocal blade means toward said closure plate.

9. A sewing machine thread cutting mechanism comprising:

a suction tube formed with an inlet chamber having a thread inlet opening arranged proximate the stitch forming area of the machine;

a pivotally movable thread cutting blade adapted for reciprocatory movement across the inlet opening and operable to cut a thread chain drawn into the suction tube; and resilient biasing means arranged to exert a force component against the thread cutting blade whereby biasing same against the interior of said suction tube in the inlet opening area.

10. A sewing machine thread cutting mechanism comprising:

fixed knife means mounted adjacent a stitch forming area of the machine;

reciprocal knife means having a blade portion adapted for cooperation with said fixed knife means in severing threads; and means for mounting said reciprocal knife means such that said blade portion is normally biased into contact with said fixed knife means under a first low contact pressure and cooperates with said fixed knife means under a higher pressure when threads are introduced between the fixed and reciprocal knife means.

* * * * *